United States Patent [19]

Danno et al.

[11] Patent Number: 4,625,149

[45] Date of Patent: Nov. 25, 1986

[54] METAL VAPOR DISCHARGE LAMP INCLUDING AN INNER BURNER HAVING TAPERED ENDS

[75] Inventors: Yuji Danno; Kouzou Kawashima, both of Yokohama, Japan

[73] Assignee: Kabushiki Kaisha Toshiba, Kawasaki, Japan

[21] Appl. No.: 639,219

[22] Filed: Aug. 9, 1984

[30] Foreign Application Priority Data

Aug. 10, 1983 [JP] Japan ..... 58-144993

[51] Int. Cl.[4] ..... H01J 61/33

[52] U.S. Cl. ..... 313/623; 313/634

[58] Field of Search ..... 313/623, 624, 625, 634, 313/25

[56] References Cited

U.S. PATENT DOCUMENTS

| | | | |
|---|---|---|---|
| 2,761,086 | 8/1956 | Noel et al. | 313/634 X |
| 3,932,782 | 1/1976 | Kopelman | 313/625 |
| 4,277,715 | 7/1981 | Claassens et al. | 313/625 |
| 4,503,356 | 3/1985 | Kobayashi et al. | 313/634 |

FOREIGN PATENT DOCUMENTS

| | | | |
|---|---|---|---|
| 49-12981 | 3/1974 | Japan . | |
| 37644 | 3/1984 | Japan | 313/634 |

*Primary Examiner*—David K. Moore
*Assistant Examiner*—K. Wieder
*Attorney, Agent, or Firm*—Cushman, Darby and Cushman

[57] ABSTRACT

A metal vapor discharge lamp has a light emitting tube of translucent ceramics which includes a straight tube section of a predetermined diameter and a pair of tube end sections having their diameter gradually decreased from the straight tube section. The light emitting tube is formed such that a height from a corresponding sealing member to a boundary of the straight tube section and tube end section is greater than a height from the sealing member to the lower end of a radiator section of a discharge electrode and that a minimum radius of the tube end section of the light emitting tube is greater than an outer radius of the radiator section of the discharge electrode by a difference of 1.5 mm or less left therebetween.

5 Claims, 4 Drawing Figures

METAL VAPOR DISCHARGE LAMP INCLUDING AN INNER BURNER HAVING TAPERED ENDS

BACKGROUND OF THE INVENTION

This invention relates to a metal vapor discharge lamp including a translucent heat-resistant, corrosion-resistant ceramic tube as a light emitting tube with both the ends thereof sealed with ceramic sealing members.

A metal vapor discharge lamp, such as a high-pressure sodium lamp, includes a light emitting tube or inner burner of a translucent ceramic of a kind which has a resistance to sodium, such as alumina ceramics, discharge electrodes are attached to the ceramic, and it is filled with a starting rare gas and a sodium amalgam. The translucent ceramic tube is a straight one usually having a uniform diameter. Since, however, both the open ends of the tube cannot be melt-sealed as in the case of a quartz glass tube, they are hermetically sealed by the corresponding sealing members made of ceramic material which is the same as the ceramic material of the light emitting tube. The discharge electrodes are supported by the corresponding sealing members, respectively. The light emitting tube is sealed within an outer glass envelope equipped at one end with a base to which a lead-in wire from the light emitting tube is connected. Vacuum is usually maintained within the outer glass envelope. The high-pressure sodium lamp so formed finds a wider acceptance as a light source for an energy saving. With this trend, various types of such lamps are now being developed.

In the high-pressure sodium lamp, a condensation of sodium amalgam often occurs on the end of the light emitting tube of alumina ceramics during the extinguishing of the lamp. In this case, upon the starting of the lamp, a discharge arc spot may be formed on this sodium amalgam in place of on the electrode. This phenomenon is what is called a "back arc" phenomenon. The occurrence of this phenomenon abnormally heats the ceramic portion of the tube, causing cracks thereon and a consequent lamp failure.

In order to solve the above-mentioned problem, a means is disclosed in Japanese Patent Publication No. 49-12981 whereby a difference between the outer diameter of a discharge electrode and the inner diameter of a light emitting tube made of ceramics is made small. In a high power output (for example, 700 W, 1,000 W) type lamp and high color-rendering type lamp, use is made, of a ceramic tube of a relatively great diameter as a light emitting tube. For example, an inner-diameter of about 10 mm or 14 mm can be used to obtain a high efficiency and high color-rendering property. Such a lamp is readily subject to the above-mentioned "back arc" phenomenon. However, if the invention of Japanese Patent Publication No. 49-12981 is applied to a light emitting tube of greater inner diameter, it is necessary to increase the outer diameter of the associated electrodes. The electrode dimension is determined by a lamp characteristic, for example, the lamp current, and has no direct dependency upon the inner diameter of the light emitting tube. If the electrode dimension is caused to increase depending upon the inner diameter of the light emitting tube without paying attention to the above-mentioned restrictions, then the starting characteristic of the lamp is degraded and/or an electron emissive material is abnormally sputtered from the electrode during the lighting of the lamp, causing the occurrence of blackening on the tube and portion of the light emitting tube. The blackening phenomenon results in a lowering in the lamp luminous flux, an abnormal rise in the lamp voltage and a consequent degradation in the expectant life characteristic. In these respects, the technique of Japanese Patent Publication No. 49-12981 is insufficient for a lamp having a large-diameter light emitting tube.

U.S. Pat. No. 3,932,782 discloses the prior art of the end configuration of the light emitting tube. In this patent, materials added within the light emitting tube are readily deposited on the boundary portion between a tubular body portion and an end portion of the light emitting tube. For a large-diameter tube, the additive may be condensed in a position away from the electrode, thus producing a back arc phenomenon due to the arc spot formed on the additives, such as sodium amalgam.

For example, Japanese Utility Model Publication No. 51-1641 discloses a method for controlling the coolest temperature on the tube end section by varying the configuration of sealing members for use at both the ends of a light emitting tube. This method, however, involves a high processing cost and a greater heat loss at the tube end section.

SUMMARY OF THE INVENTION

It is accordingly the object of this invention to provide a metal vapor discharge lamp which can prevent the occurrence of a back arc phenomenon even if a light emitting tube of a relatively large diameter is used.

The light emitting tube of the metal vapor discharge lamp of this invention is made of translucent ceramics material and comprised of a straight tube section having a predetermined diameter and a pair of tube end sections formed at both the ends of the straight tube section such that they are tapered from the straight tube section. The tapered end sections for the light emitting tube are sealed by the corresponding sealing members made of ceramics. A pair of discharge electrodes are formed one at the corresponding end portion of the light emitting tube such that they are supported by the corresponding sealing members. Each electrode has an electrode rod and a radiator section located around the electrode rod. The light emitting tube is so formed that a height from the corresponding sealing member to a boundary between the straight tube section and the tapered tube end section is larger than a height from the sealing member to the lower end of the radiator section of the discharge electrode and that the minimum radius of the tapered end section of the light emitting tube is greater than the outer radius of the radiator section of the discharge electrode with a difference of 1.5 mm or less left therebetween. The use of the light emitting tube of such a configuration causes no back arc phenomenon. The electrode dimension can be designed independently of the tube end configuration, impuriting neither the starting characteristic nor the expectant life characteristic of the lamp.

BRIEF DESCRIPTION OF THE DRAWINGS

The other objects and advantages will be apparent from the following description taken in conjunction with the accompanying drawings, in which.

DETAILED DESCRIPTION OF THE PREFERRED EMBODIMENTS

Figure 1:
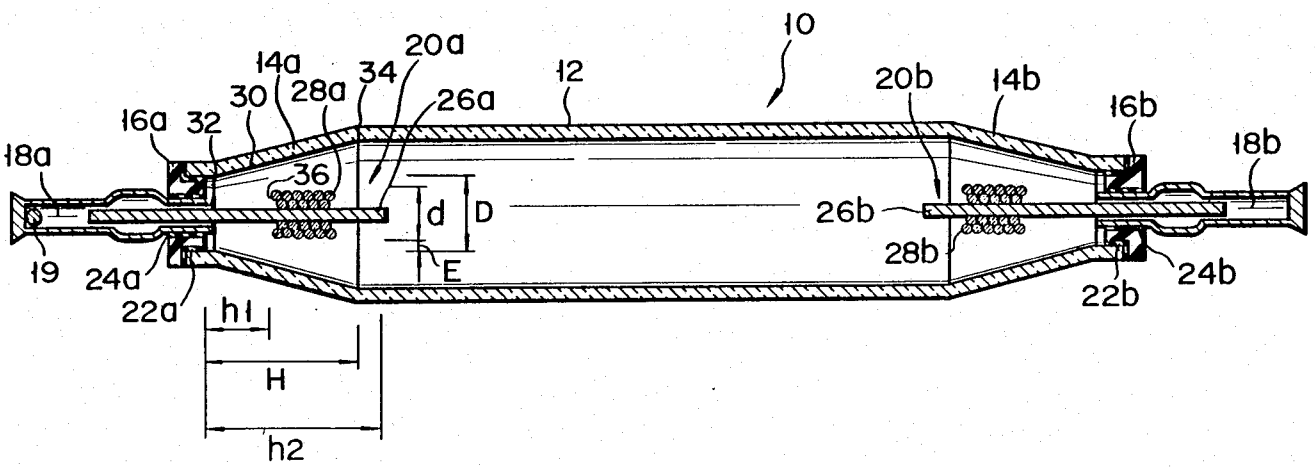
FIG. 1 is a cross-section showing a metal vapor discharge lamp according to one embodiment of this invention.

FIG. 1 is a cross-section showing a light emitting tube for a 940 W high-pressure sodium lamp according to one embodiment of this invention. A light emitting tube 10 is formed of light-transmission ceramics, such as a translucent alumina ceramics, and comprised of a straight tube section 12 of a predetermined diameter and a pair of tapered tube end sections 14*a*, 14*b* symmetrically formed at both the ends of the straight tube section 12. The tube end sections 14*a*, 14*b* have a circular truncated cone configuration whose diameter is gradually decreased from the straight tube section 12. The straight tube section 12 is formed integral with the tube end sections 14*a*, 14*b* of the light emitting tube 10 and the valve wall thereof has substantially the uniform thickness throughout. Sealing members 16*a* and 16*b* made of ceramics are fitted into the tube end sections 14*a* and 14*b*, respectively. Metal tubes 18*a* and 18*b* are made of, for example, niobium and extend through the centers of the sealing members 18*a* and 18*b*, respectively. The metal tubes 18*a* and 18*b* support electrodes 20*a* and 20*b*, respectively, and permit the introduction of electricity. The metal tube 18*a* also permits the evacuation of the tube during the manufacture of the light emitting tube, as well as the filling of metals and rare gases for starting. The metal tube 18*a* constitutes the coolest section where unevaporated added metals are held during the operation of the lamps. The metal tube 18*a* is located at the lower side of the lamp when the light emitting tube is lit in the perpendicular position.

The hermetic sealing of the sealing member 16*a* to the light emitting tube 10 and that of the sealing member 16*a* to the metal tube 18*a* are effected at a sealing area 22*a* and sealing area 24*a*, respectively, by a sealing material, such as soldering glass mainly consisting of aluminium oxide and calcium oxide. Similarly, the sealing member 16*b* is hermetically sealed to the light emitting tube 10 and to the metal tube 18*b* at a sealing area 22*b* and sealing area 24*b*, respectively, by the soldering glass. The electrode 20*a* is such that a tungsten wire is coiled on an electrode rod 26*a*. An electron-emissive material is filled into, or coated on, the turns of a coil section 28*a*. Similarly, the electrode 20*b* is comprised of an electrode rod 26*b* and coil section 28*b*, and an electron-emissive material is filled into, or coated on, the turns of the coil section 28*b*. The coil sections 28*a*, 28*b* serve as radiator sections.

An additive metal such as sodium amalgam and a rare gas for starting, such as a xenon gas or a Penning mixture gas (neon and argon) is filled into the tube.

The light emitting tube 10 is held within an outer glass envelope, not shown, which is evacuated to a vacuum level. A current is supplied from a power source to the electrodes 20*a*, 20*b* of the light emitting tube through a base attached to the outer glass envelope. These belong to the ordinary technique and are not shown.

The tube will be explained below by focusing on the left-hand side of the light emitting tube in FIG. 1 where an additive metal is present, because a back arc phenomenon typically occurs at that side of the light emitting tube. The application of this invention to at least the tube end section 14*a* can prevent the occurrence of the back arc phenomenon.

According to this invention, the light emitting tube 10 has an inner diameter of 14.0 mm at the straight tube section and the tube end section 14*a* has a minimum inner diameter D of 7.25 mm. The electrode 20*a* is comprised of an electrode rod 26*a* having a diameter of 1.7 mm and a 0.7 mm-diameter tungsten filament which is coiled on and around the electrode rod to provide the above-mentioned coil section 28*a* having an outer diameter d of 4.5 mm. As a consequence, a difference E between the minimum radius of the tube end section 14*a* and an external radius d/2 of the coil section is 2.75/2 mm. If the difference E is smaller, a relatively high temperature is held at a side wall 30 of the tube end section 14*a* and at a surface 32 of the sealing member 16*a*, making it difficult for sodium amalgam to be deposited on the side wall 30 and surface 32. A boundary 34 between the straight tube section 12 and tube end section 14*a* of the light emitting tube 10 is located further from the surface 32 of the sealing member 16*a* than from the lower end 36 of the coil section 28*a*. That is, a height H from the surface 32 of the sealing member to the boundary 34 is formed such that it is higher than a height $h_1$ from the surface 32 to the lower end 36 of the coil section 28*a*. This arrangement can prevent the deposition of the sodium amalgam on the boundary 34 and thus the occurrence of the back arc phenomenon even in the case of a light emitting tube 10 of a relatively greater diameter. The electrode 20*a* can be independently designed with the lamp current in mind, impairing neither the starting characteristic nor the expectant life characteristic.

Figure 2:
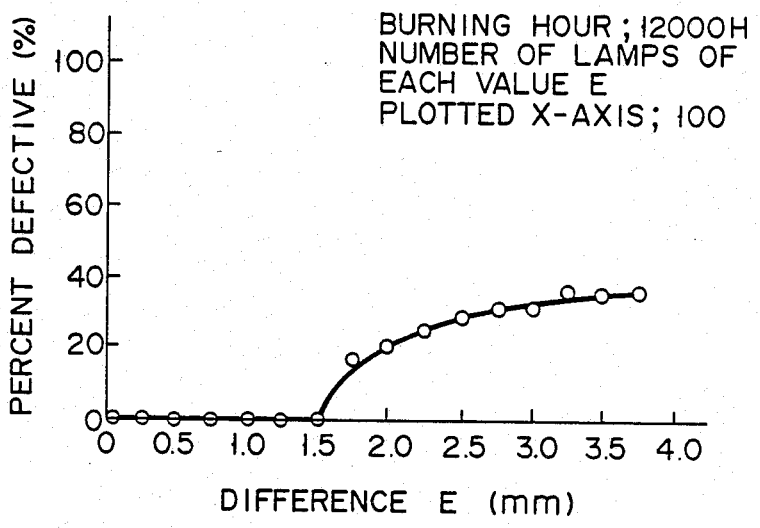
FIG. 2 is a graph showing a percent defective of lamps with respect to a difference E in FIG. 1.

Explanation will be made of the reason why the above-mentioned difference E is adopted to be $0<E\leqq 1.5$. For $0\geqq E$, the electrode 20*a* cannot be set within the light emitting tube 10, while for $E>1.5$ mm the percent of defective lamps is prominently increased due to the occurrence of the back arc phenomenon within the tube end section 14*a* as shown in FIG. 2. FIG. 2 shows the percent of defective lamps during the life of the lamps which were tested by varying the difference E under the condition that a basic lamp structure is the same as that according to the above-mentioned embodiment of this invention. As will be appreciated from the graph in FIG. 2, for $E>1.5$ mm the increase in the number of the reject lamps is due primarily to the deposition of the sodium amalgam on the side wall 30 of the tube end section 14*a* and on the surface 32 of the sealing member 16*a* and the consequent back arc phenomenon.

It is preferable that the height H from the surface 32 of the sealing member 16*a* to the boundary 34 be not in excess of a height $h_2$ from the surface 32 to the top end of the electrode 20*a*. This is because the positive column of the discharge arc is formed preferably within the straight tube section of the light emitting tube 10.

Although in this embodiment a 940 W high-pressure sodium lamp has been explained as one example, this invention can be applied to a relatively high-output lamp, such as a 660 W, a 700 W, a 1,000 W lamp. In 660 W, 700 W ordinary lamps, use was made of an alumina ceramic tube having a straight tube section of an inner diameter of 10 mm and a tube end section having a minimum inner diameter D of 7.25 mm. The electrode rod was 1.7 mm in diameter and the outer diameter of the coil section was 4.5 mm. The arrangement of a 1,000

W lamp is the same as that of the 940 W lamp. A high color rendering type lamp which utilizes the self-absorption of a sodium D line uses a larger-diameter light emitting tube than that of the ordinary lamp. For example, a 250 W lamp used a hight emitting tube of 10.8 mm in inner diameter, and a 400 W lamp a light emitting tube of 13 mm in inner diamter. This invention, even applied to such a high color rendering type lamp, has a greater advantage. A greater advantage is also obtained even if this invention is applied to a lamp using a light emitting tube having a straight tube section of 9 mm to 30 mm in inner diameter. Even where the diameter of the straight tube section of the light emitting tube is varied dependent upon the kinds of the lamp, if the lamp end section has the same inner diameter, it is possible to use sealing members of the same configuration according to this invention. This is an added effect of this invention.

Figure 3:
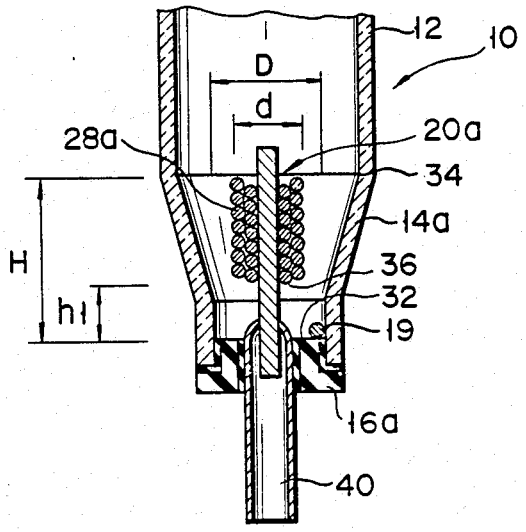
FIGS. 3 and 4, each, show a metal vapor discharge lamp according to another embodiment of this invention.

A second embodiment of this invention will be explained below by referring to FIG. 3. In the lamp of FIG. 3, a niobium tube 40, unlike the first embodiment, does not function as an exhaust tube or as a coolest portion where an additive metal is condensed. It has a mere function of supporting the electrode 20*a* and introducing electricity. When the niobium tube 40 is used, a sodium amalgam is present on the tube end section. If, in this case, a difference E between a minimum radius D/2 of a tube end section 14*a* and a maximum radius d/2 of an electrode 20*a* is $0<E\leqq 1.5$ mm and a height H from a surface 32 of a sealing member 16*a* to a boundary 34 is greater than a height $h_1$ from the surface 32 to the lower end 36 of a coil section 28*a*, it is possible to prevent a back arc phenomenon.

In case that a sodium amalgam is present in a position shown in FIG. 3, an arc spot is eventually formed on the electrode 20*a* due to the proximity of a discharge path starting from the sodium amalgam 19 to a discharge path starting from the electrode 20*a*. Even if the discharge starts from the sodium amalgam, it is shifted to the discharge path starting from the electrode prior to arc transition.

Figure 4:
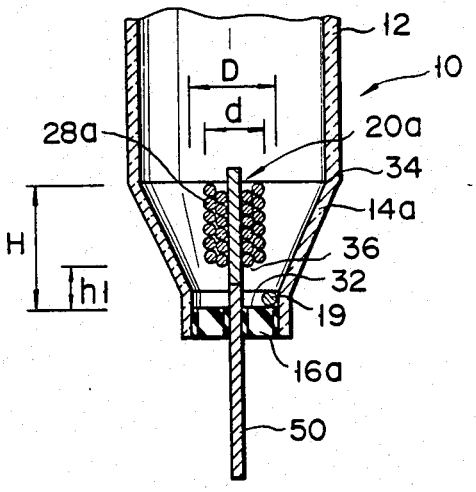

A metal vapor discharge lamp according to a third embodiment of this invention will be explained below by referring to FIG. 4. In this lamp, a niobium wire 50 is used as a current supply line to an electrode 20*a*. Thus, a sodium amalgam 19 is present, like the second embodiment, at the tube end section 14*a*. In this case, it is only necessary that a difference E between a minimum radius D/2 of the tube end section 14*a* and a maximum radius d/2 of an electrode 20*a* be $0<E\leqq 1.5$ mm and that a height H from a surface 32 of a sealing member 16*a* to a boundary 34 be greater than a height $h_1$ from the surface 32 to the lower end 36 of a coil section 28*a*.

Although this invention has been explained in connection with the embodiments, it is not restricted thereto. The tube end sections 14*a* and 14*b* may have surface, for example, body of revolution, paraboloid of revolution or elipsoidal surface of revolution and so on. For an electrode having a radiator section, in place of the coil section, such as a sintered type electrode, the same effect can also be obtained. As a sealing material use may be made of alkali metals or metal halides.

What is claimed is:

1. A metal vapor discharge lamp comprising:

a light emitting tube of translucent ceramics having a straight tube section having a diameter of greater than 9 mm and a pair of tube end sections formed integrally with said tube, one at each end of said straight tube section thereby defining a first end and a second end such that each said tube end section has its diameter gradually decreased from a boundary with said straight tube section;

a pair of sealing members made of ceramics which hermetically seal said ends of said decreased-diameter portions of said tube end sections;

a pair of discharge electrodes each having an electrode rod and a radiator section formed on and around the electrode rod, said discharge electrodes formed one at each end of the light emitting tube such that each said discharge electrode is supported by the corresponding sealing member;

at least one light emitting metal added within said light emitting tube; and a rare gas within the light emitting tube for starting the tube;

wherein:

said light emitting tube being formed such that a height H from the sealing member on said first end to the boundary of the straight tube section and the tube end section on said first end is greater than a height $h_1$ from the first end sealing member to a closest end of said radiator section of the discharge electrode on said first end, or $H>h_1$, and that a minimum radius D/2 of the tube end section of the light emitting tube is greater than an outer radius d/2 of said radiator section of said discharge electrode with the difference E between these radii being 1.5 mm or less, or $E=D/2-d/2\leqq 1.5$ mm.

2. A metal vapor discharge lamp according to claim 1, in which said height H from said first end sealing member to said first end boundary of said straight tube section and said tube end section is located within a range between (a) said height $h_1$ from said first end sealing member to the lower end of said radiator section of said first end discharge electrode, and (b) a height $h_2$ from the sealing member to the top end of said first end discharge electrode which extends into a discharge space, or $h_1<H<h_2$.

3. A metal vapor discharge lamp according to claim 1, in which said diameter of said straight tube section of said light emitting tube is less than 30 mm.

4. A metal vapor discharge lamp comprising:

a hollow tube having first and second ends, formed with a straight section, and an end section on said first end, wherein the diameter of said end section decreases from the boundary with said straight section toward said first end, means for sealing the ends of said light emitting tube;

a discharge electrode on said first end including:

(a) an electrode rod, and (b) means for radiating, formed around said rod at said one end of said tube and supported by said sealing means; and light emitting means, within said tube, for emitting light when said electrode is energized;

wherein:

(a) a height H from said first sealing means on said first end of said tube to said boundary is greater than a height $h_1$ from said first sealing means to the closest end of said radiating means, or $H>h_1$, and (b) the minimum radius of said first end section D/2 is greater than the outer radius d/2 of said radiating means, or $D/2>d/2$, and (c) $D/2-d/2\leqq 1.5$ mm, these criteria minimizing the back arc phenomena of the lamp.

5. A lamp as in claim 4 wherein said straight section of said tube is of a constant diameter greater than or equal to 9 mm.

* * * * *